US006499973B2

(12) United States Patent
Maejima

(10) Patent No.: US 6,499,973 B2
(45) **Date of Patent: *Dec. 31, 2002**

(54) TURBO MOLECULAR PUMP

(75) Inventor: Yasushi Maejima, Narashino (JP)

(73) Assignee: Seiko Instruments Inc. (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/128,712

(22) Filed: Aug. 4, 1998

(65) Prior Publication Data

US 2001/0022941 A1 Sep. 20, 2001

(30) Foreign Application Priority Data

Oct. 3, 1997 (JP) ..... 9-288025

(51) Int. Cl.[7] ..... F04B 17/00; F04B 35/04; C23C 16/00

(52) U.S. Cl. ..... 417/423.4; 118/715; 415/90

(58) Field of Search ..... 118/715; 415/90, 415/143; 417/423.4

(56) References Cited

U.S. PATENT DOCUMENTS 3,644,051 A * 2/1972 Shapiro ..... 415/90
5,074,747 A * 12/1991 Ikegami et al. ..... 415/55.1
5,217,346 A * 6/1993 Ikegami et al. ..... 415/55.1
5,234,862 A * 8/1993 Aketagawa et al. ..... 437/103
5,688,106 A * 11/1997 Cerruti et al. ..... 415/90
5,707,213 A * 1/1998 Conrad ..... 415/177
6,050,782 A * 4/2000 Lembke ..... 417/205
2001/0022941 A1 * 9/2001 Maejima ..... 417/423.4

FOREIGN PATENT DOCUMENTS

JP 7279888 10/1995

* cited by examiner

*Primary Examiner*—Jeffrie R. Lund
(74) *Attorney, Agent, or Firm*—Adams & Wilks

(57) ABSTRACT

A turbo molecular pump comprises a pump body having a vacuum chamber, a gas inlet port and a gas outlet port. A rotor shaft is mounted in the pump body for undergoing rotation. A rotor vane section is disposed in the vacuum chamber and has rotor vanes connected to the rotor shaft for rotation therewith. A stator vane section is disposed in the vacuum chamber and has stator vanes interleaved with the rotor vanes in spaced-apart relation. A distance between at least one of the rotor vanes and an adjacent one of the stator vanes is set to a value in accordance with a mean free path of molecules contained in a gas flowing between the rotor vanes and the stator vanes such that a pressure of the vacuum chamber is not less than 10 mTorr during a normal operation of the turbo molecular pump. Alternatively, the distance between at least one of the rotor vanes and an adjacent one of the stator vanes is set to a value in accordance with a mean free path of molecules contained in a gas flowing between the rotor vanes and the stator vanes such that a discharge throughput of the turbo molecular pump during a normal operation thereof is not less than 1000 SCCM.

8 Claims, 4 Drawing Sheets

Throughput characteristic (N2)

Auxiliary pump : Dry pump 1300 [l/min.]

TURBO MOLECULAR PUMP

BACKGROUND OF THE INVENTION

1. Field of the Invention

The present invention relates to a turbo molecular pump used, for instance, as a vacuum device for a semiconductor manufacturing apparatus.

2. Description of Related Art

A turbo molecular pump is designed such that rotor vanes attached to a rotor shaft rotating at high velocity and stator vanes fixed by an outer casing are alternately arranged so that a pair of the rotor vane and the stator vanes are arranged in multi-stages in an axial direction of the rotor axis. The rotor vanes include a plurality of blades each inclined at a predetermined angle. The stator vane includes a plurality of blades similarly to the rotor vane, and the inclined direction of each blade is opposite from the inclined direction of the blade provided in the rotor vane.

An axial interval between the rotor vane and the stator vane is determined from a viewpoint of convenience in design and so on. For example, the axial interval between the rotor vane and the stator vane located close to a inlet port is set to about 5 mm.

In the turbo molecular pump thus constructed, the rotor vanes are rotated by the rotation of the rotor shaft, and the gas molecular is beaten in the rotating direction so that the blades of rotor vanes are moved axially, thereby carrying out the discharge of the gas.

The turbo molecular pump of this type is used, for instance, for the purpose of the discharge for a vacuum chamber of the semiconductor manufacturing apparatus. That is, in order to carry out processing of the semiconductor in the vacuum chamber, it is necessary to always supply gas to the vacuum chamber, and discharge the gas supplied thereto by the turbo molecular pump.

However, recent tendency is directed toward the increase in gas amount to be supplied to the vacuum chamber, and also, the gas amount to be discharged by the turbo molecular pump in a normal operation is increasing.

A test in throughput characteristic was conducted to confirm whether or not a conventional turbo molecular pump can provide sufficient vacuum property (discharge performance) in case where the amount of the gas to be discharged therefrom is increased. The test result is shown-by one-dotted chain line A in FIG. 4.

Here, the gas to be discharged was nitrogen ($N_2$), and a dry pump of 1300(1/min) was used as an auxiliary pump.

From the test result, it was found that the sufficient vacuum property was obtained (for example, the pressure of not more than $10^{-2}$ Torr, i.e. 10 mTorr was obtained) in the case where the throughput of the gas to be discharged was small, but the sufficient vacuum property could not be obtained (for example, the pressure was larger than 10 mTorr) in the case where the throughput of the gas to be discharged was large.

Based on this result, the present inventor has made the detailed study to seek a cause or reason why the sufficient vacuum property could not be obtained in the case where the throughput of the gas was large, and discovered and obtained a novel view that the lowered discharge performance was caused by a fact that the discharged gas did not form molecular flow in an axial space between the rotor vanes and stator vanes near the inlet port of the turbo molecular pump. In other words, the present inventor has obtained such a novel view that the lowering in the vacuum property in association with the increased throughput of the gas was closely related to the axial interval between the rotor vanes and the stator vanes.

SUMMARY OF THE INVENTION

The present invention was made on the basis of the above-described novel view, and an object of the present invention is to provide a turbo molecular pump capable of ensuring the sufficient vacuum property while maintaining the increased throughput of the gas even when the throughput of the gas to be discharged in a normal operation is increased.

To attain the above-described object, a turbo molecular pump according to the present invention is characterized by comprising:

a rotor shaft;

a bearing for rotatably supporting the rotor shaft;

a motor for rotating the rotor shaft supported by the bearing;

rotor vanes of multiple stages provided to the rotor shaft; and stator vanes of multiple stages arranged between the rotor vanes of multiple stages, respectively;

wherein that an axial interval between at least one of the rotor vanes and a corresponding one of the stator vane is set to a value by which a gas can be dealt as a molecular flow under a condition of pressure not less than 10 mTorr during a normal operation.

The present invention can be also expressed as follows:

That is, a turbo molecular pump according to the present invention is characterized by comprising:

a rotor shaft;

a bearing for rotatably supporting the rotor shaft;

a motor for rotating the rotor shaft supported by the bearing;

rotor vanes of multiple stages provided to the rotor shaft; and stator vanes of multiple stages arranged between the rotor vanes of multiple stages, respectively;

wherein at least one axial interval between one of the rotor vanes and a corresponding one of the stator vane is set to a value by which a gas can be dealt as a molecular flow under a condition that a discharge throughput during a normal operation is not less than 1000 SCCM.

The one of rotor vane is located closest to a inlet port among the rotor vanes of multiple stages, and the corresponding one of the stator vane is located closest to the inlet port among the stator vanes of multiple stages.

The at least one axial interval between one of the rotor vanes and a corresponding one of the stator vane is set based on a mean free path of molecular gas.

As described above, according to the present invention, the axial interval between the stator vane and the rotor vane is set to such a value as to be capable of dealing with the gas as the molecular flow under the condition that the pressure in the inlet port is equal to or more than 10 mTorr during the normal operation.

Therefore, according to the present invention, the gas can be dealt as the molecular flow under the condition that the pressure is equal to or more than 10 mTorr during the normal operation, and sufficient discharge performance can be obtained. Thus, even if the throughput of the gas supplied to the vacuum chamber during the normal operation is increased compared with the conventional one, the present invention can ensure the required pressure (required vacuum property) while maintaining the increased throughput of the gas.

DETAILED DESCRIPTION OF THE PREFERRED EMBODIMENT

The basic thought of the present invention is described hereafter, prior to the description regarding an embodiment of the present invention.

Figure 1:
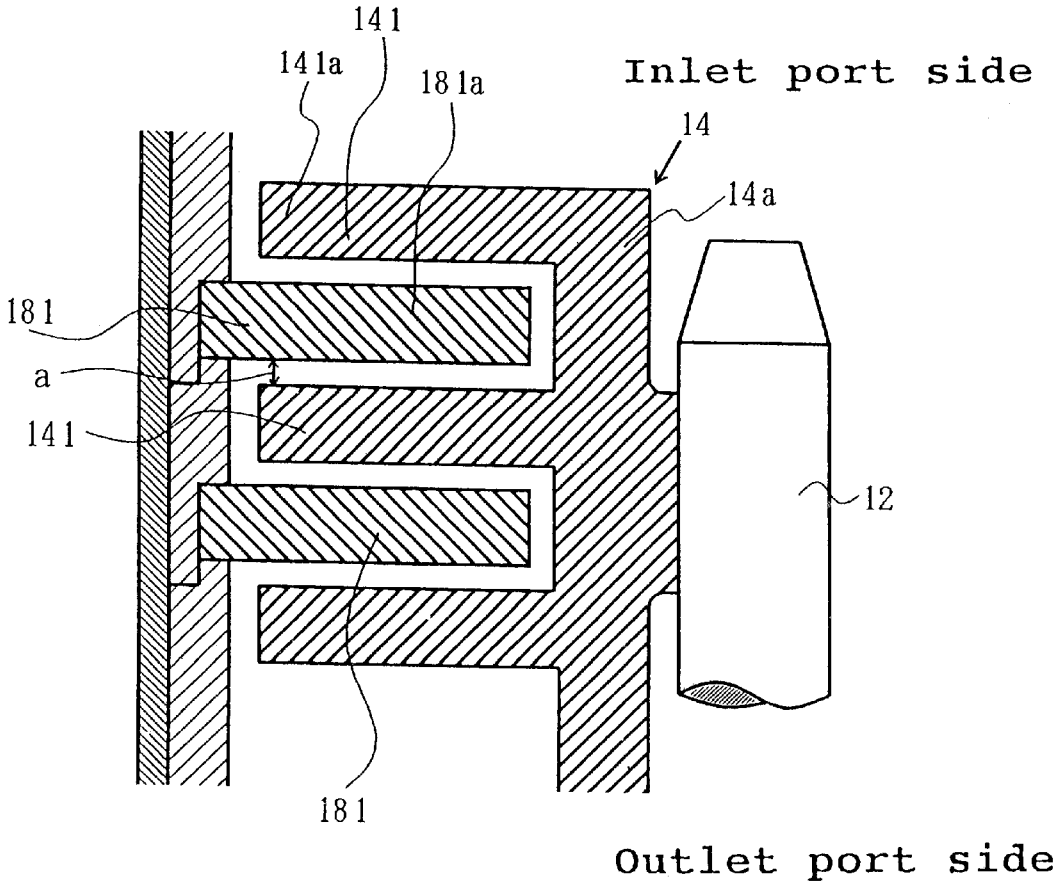
FIG. 1 is a sectional view showing major parts of a turbo molecular pump for explanation about a basic thought of the present invention.
Figure 2:
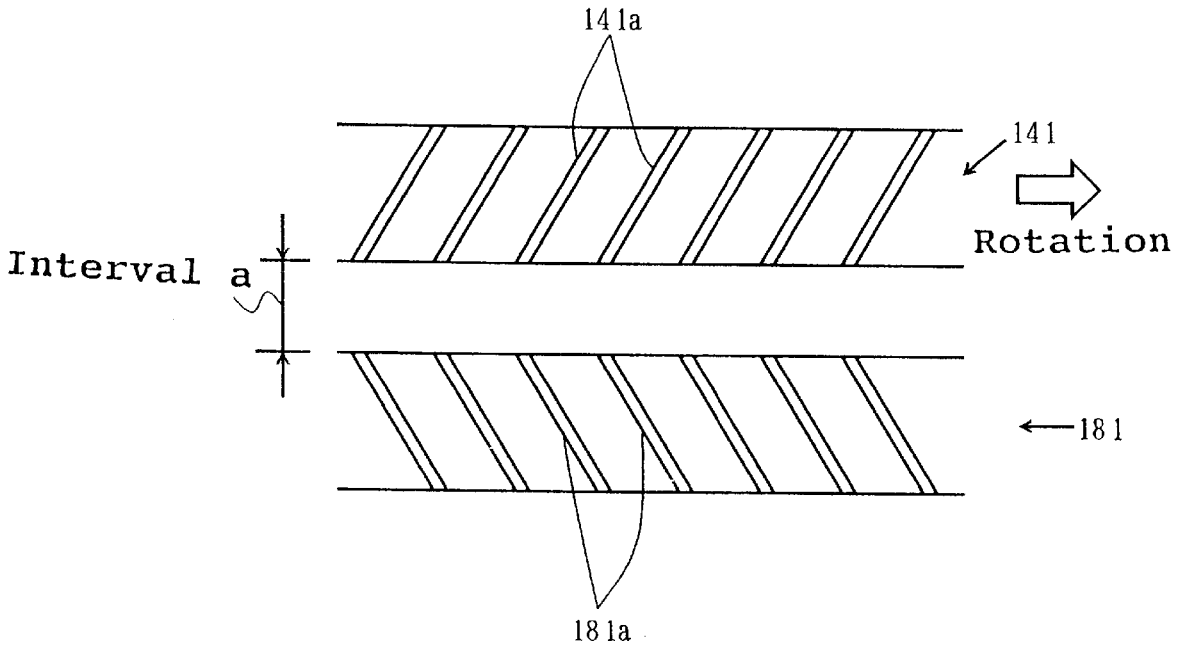
FIG. 2 is a developed view of a rotor vane and a stator vane to show the major parts.

FIG. 1 is a sectional view showing major parts of the present invention with other parts omitted to simplify the explanation about the basic thought of the present invention. FIG. 2 is a developed view showing a relationship between a rotor vane 141 and a stator vane 181.

The present invention has been based on the above-described novel view, and as shown in FIG. 1 an axial interval a between the rotor vane 141 and the stator vane 181 at least closest to an inlet port is set to such a value as to deal with gas as molecular flow under a condition that the pressure in the inlet port during the normal operation is not less than 10 mTorr.

In case where the turbo molecular pump is used to discharge gas supplied to a vacuum chamber during the normal operation, the throughput of the gas to be discharged is predetermined. Therefore, the turbo molecular pump must satisfy a condition required by that predetermined discharge throughput during the normal operation and must provide vacuum property (for example, pressure of not more than 20 mTorr) concurrently needed. Accordingly, the present invention can be expressed as follows: That is, the axial interval a between the rotor vane 141 and the stator vane 181 at least closest to the inlet port is set to such a value as to deal with gas as the molecular flow under a condition that the discharge throughput during the normal operation is not less than 1000 SCCM.

Next, a method of setting in detail the axial interval a, for example, between the rotor vane 141 and the stator vane 181 on the basis of the above-described thought is described hereafter.

As described above, whether or not the gas can be dealt as the molecular flow in the axial interval between the rotor vane 141 and the stator vane 181 depends on a mean free path of the molecular gas. This mean free path λ is expressed approximately by the following formula (1):

$$\lambda = 0.05/\text{pressure (mm)} \quad (1)$$

Here, the unit for the pressure in the formula (1) is Torr.

If the mean free path λ is not less than the above-described interval a, the gas can be dealt as the molecular flow.

Next, a case where the gas is dealt as the molecular flow under a condition that the pressure is not more than 20 mTorr during the normal operation is described.

From the formula (1), the mean free path λ under the condition that the pressure is 20 mTorr is 2.5 mm (λ=2.5 mm).

Therefore, if the axial interval a between the rotor vane 141 and the stator vane 181 is set to not more than 2.5 mm, then the gas can be dealt as the molecular flow under the condition of pressure of not more than 20 mTorr.

In addition, an axial interval between a rotor vane 142 and a stator vane 182, an axial interval between a rotor vane 143 and a stator vane 183, and an axial interval between a rotor vane 144 and a stator vane 184 are similarly set so that the gas can be dealt with as the molecular flow (these vanes 142 to 144 and 182 to 184 are described later).

Next, a preferred embodiment of the present invention is described with reference to FIG. 3.

Figure 3:
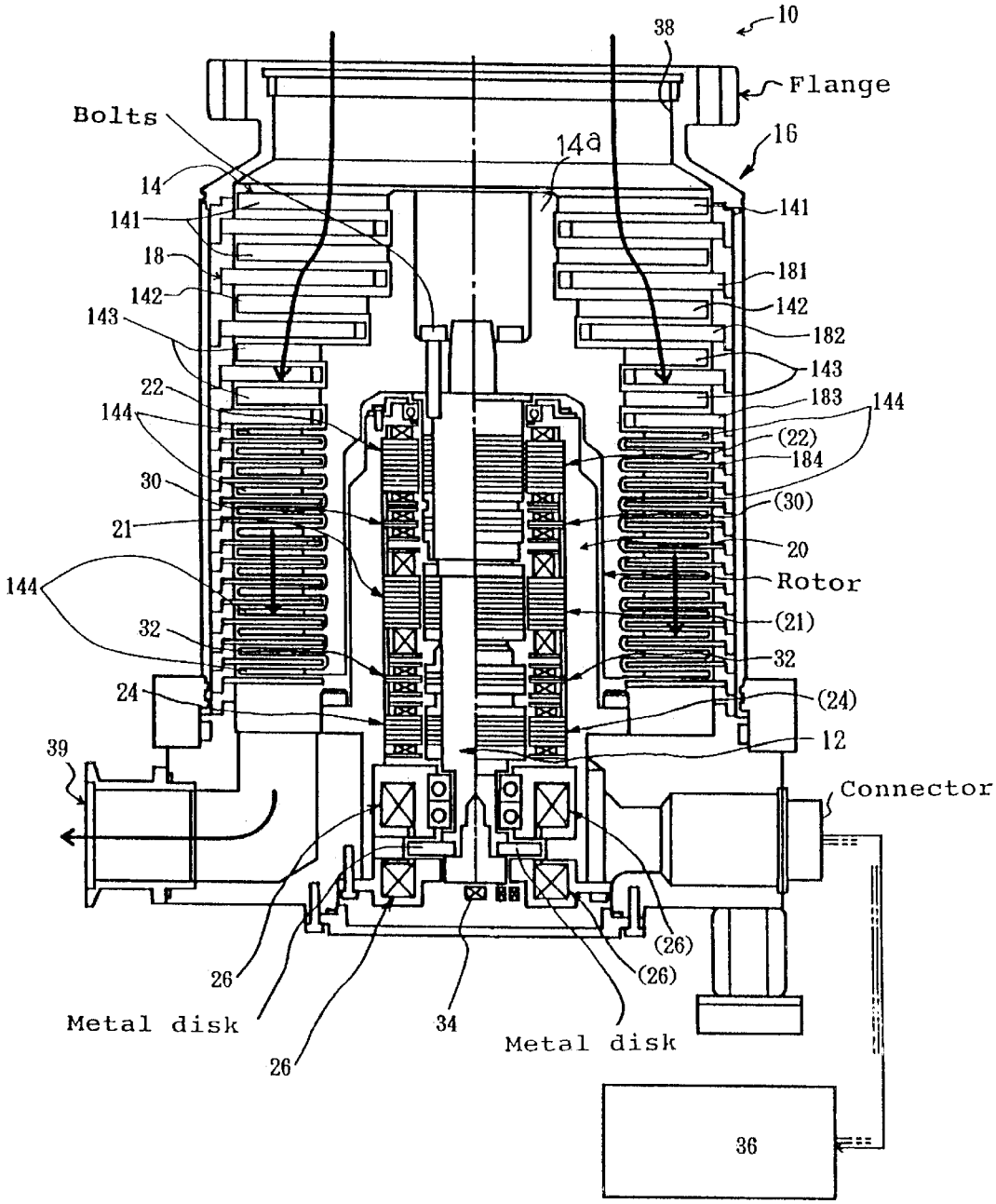
FIG. 3 is a sectional view showing the turbo molecular pump according to an embodiment of the present invention.

FIG. 3 is a sectional view showing the entire configuration of a turbo molecular pump according to the embodiment of the present invention.

The turbo molecular pump 10 of the embodiment includes, as shown in FIG. 3, a substantially cylindrical rotor shaft 12, a rotor vane section 14 attached to the rotor shaft 12, a stator vane section 18 fixed by a substantially sleeve-like outer casing or pump body 16, a magnetic bearing 20 magnetically supporting the rotor shaft 12, and a motor 21 generating torque for the rotor shaft 12.

The rotor vane section 14 includes a substantially sleeve-like body 14a attached to the rotor shaft 12, and four kinds of rotor vanes 141, 142, 143 and 144 attached to the outer periphery of the cylindrical body 14*a*.

The stator vane section 18 includes four kinds of stator vanes 181, 182, 183 and 184 fixed to the inner periphery of the outer casing 16 so as to correspond to the rotor vanes 141, 142, 143 and 144, respectively.

As shown in FIG. 2, the rotor vane 141 is constructed by a plurality of blades 141*a* each inclined at a predetermined angle with respect to the rotor shaft 12 and attached to the outer periphery of the cylindrical body 14*a* to radially extend therefrom.

Each of the rotor vanes 142, 143 and 144 is constructed by a plurality of blades integrally formed at the outer periphery of the cylindrical body 14a similarly to the rotor vane 141, but the blades are different in size and inclined angle among the rotor vanes 142, 143 and 144.

As shown in FIG. 2, the stator vane 181 is constructed by a plurality of blades 181*a* each inclined in the direction opposite from the inclined direction of the blades 141*a* of the rotor vane 141.

Each of the stator vanes 182, 183 and 184 is constructed by a plurality of blades similarly to the stator vane 181, but the blades are different in size and inclined angle among the stator vanes 182, 183 and 184.

The thus constructed rotor vanes 141 to 144 and corresponding stator vanes 181 to 184 are arranged alternately in a vertical direction with axial interval one from another.

Each of the axial interval between the rotor vane 141 and the stator vane 181, the axial interval between the rotor vane 142 and the stator vane 182 and the axial interval between the rotor vane 143 and the stator vane 183 is set to 2.5 mm so that the gas under the condition of pressure of not more than 20 mTorr can be dealt as the molecular flow as described above.

With the above-described arrangement, the rotor vane 141 and the stator vane 181 form a discharge stage, the rotor vanes 142, 143 and the stator vanes 182, 183 form an intermediate stage, and the rotor vane 144 and the stator vane 184 form a compression stage.

The above-described magnetic bearing 20 includes radial electromagnets 22, 24 and an axial electromagnet 26 for respectively generating the radial magnetic force and the axial magnetic force with respect to the rotor shaft 12, radial position sensors 30, 32 and an axial position sensor 34 for respectively detecting a radial position and an axial position of the rotor shaft 12, and a control system 36 for feed-back controlling excitation currents supplied to the radial electromagnets 22, 24, and the axial electromagnet 26 based on the detection signals from the radial position sensors 30, 32 and the axial position sensor 34.

Next, the operation of the turbo molecular pump constructed according to the embodiment is described with reference to the drawings.

During the state where the turbo molecular pump is in operation, the rotor shaft 12 is held at a predetermined floating position by the magnetic bearing 20 in a non-contact relation thereto, and the motor 21 is driven to rotate the rotor shaft 12.

The rotation of each of the rotor vanes 141 to 144 between the stator vanes 181 to 184 causes the gas to be sucked through the inlet port 38, compressed, and discharged out of a outlet port 39 as shown in FIG. 3.

In this embodiment, since the gas flow can be dealt as the molecular flow in the discharge stage formed by the rotor vane 141 and the stator vane 181 and the intermediate stage formed by the rotor vanes 142, 143 and the stator vanes 182, 183, the molecules in the gas is beaten by the blades of the rotor vanes 141, 142 and 143, and thus moved toward the outlet port 39.

Figure 4:
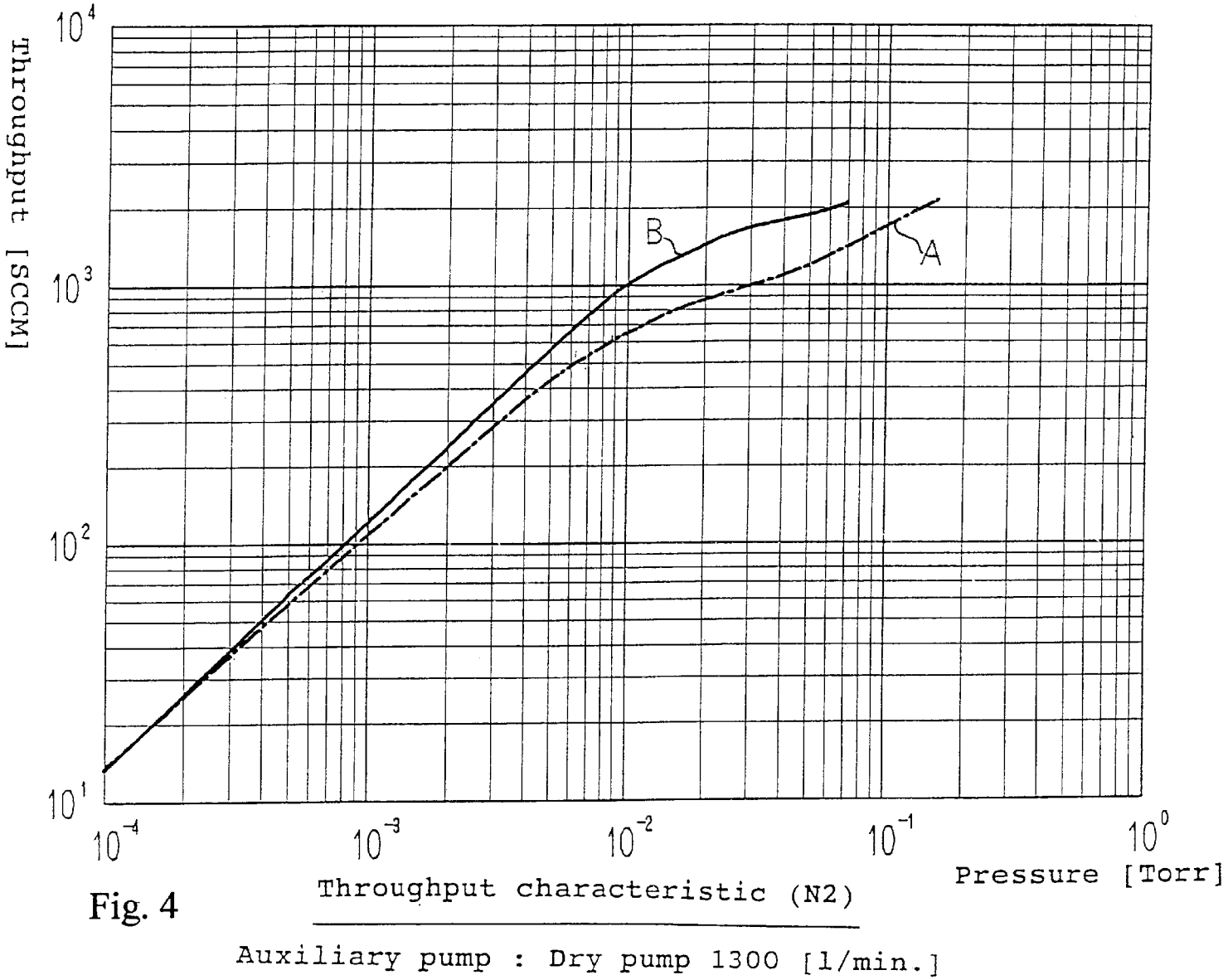
FIG. 4 shows a result of a throughput characteristic test carried out on the embodiment of the present invention and a conventional apparatus.

The test in throughput characteristic was conducted on the embodiment of the present invention similarly to the conventional apparatus, and the test result indicated by the solid line B in FIG. 4 was obtained.

Here, the axial interval between the rotor vane 141 and the stator vane 181 was set to 2.5 mm in case of the embodiment of the present invention, and it was set to 5 mm in case of the conventional apparatus.

From the test result, it was found out, for example, that if the throughput was 1000 SCCM, the pressure in case of the conventional apparatus was 30 mTorr exceeding the required pressure 20 mTorr, but the pressure in case of the embodiment was 10 mTorr. Thus, the embodiment of the present invention could ensure sufficiently required low pressure. Further, if the throughput was 1500 SCCM, the pressure in case of the conventional apparatus was not less than 60 mTorr, but the pressure in case of the embodiment was 20 mTorr. Thus, the embodiment of the present invention could ensure sufficiently required low pressure.

As described above, even if the discharge throughput is increased compared with the conventional throughput, the embodiment of the present invention can ensure the required pressure of 10–20 mTorr (required vacuum property) while maintaining the increased discharge throughput.

This is caused by the above-described setting of the axial interval between the rotor vane 141 and the stator vane 181 and so on so that the gas flow can be regarded as the molecular flow in the axial internal between the rotor vane 141 and the stator vane 181 and so on.

In addition, in the above embodiment, each of the axial interval between the rotor vane 141 and the stator vane 181, the axial interval between the rotor vane 142 and the stator vane 182, and the axial interval between the rotor vane 143 and the stator vane 183 is set to 2.5 mm so that the gas can be dealt as the molecular flow under the condition of pressure equal to or less than 20 mTorr.

As described above, according to the present invention, the axial interval between the stator vane and the rotor vane is set to such a value as to be capable of dealing with the gas as the molecular flow under the condition that the pressure in the inlet port is equal to or more than 10 mTorr during the normal operation.

Therefore, according to the present invention, the gas can be dealt as the molecular flow under the condition that the pressure is equal to or more than 10 mTorr during the normal operation, and sufficient discharge performance can be obtained. Thus, even if the throughput of the gas supplied to the vacuum chamber during the normal operation is increased compared with the conventional throughput, the present invention can ensure the required pressure (required vacuum property) while maintaining the increased throughput of the gas.

What is claimed is:

1. A turbo molecular pump comprising: a rotor shaft; a bearing for rotatably supporting the rotor shaft; a motor for rotating the rotor shaft supported by the bearing; a vacuum chamber; rotor vanes arranged in multiple pumping stages and disposed in the vacuum chamber and connected to the rotor shaft for rotation therewith; and stator vanes arranged in multiple pumping stages and disposed in the vacuum chamber and interleaved with the rotor vanes; wherein an axial interval between at least a first one of the rotor vanes and a corresponding adjacent first one of the stator vanes is set to a value in accordance with a mean free path of molecules contained in a gas flowing between the rotor vanes and the stator vanes such that a pressure of the vacuum chamber is not less than 10 mTorr during a normal operation of the turbo molecular pump.

2. A turbo molecular pump according to claim 1; further comprising a pump body having a gas inlet port and a gas outlet port; and wherein the first rotor vane and the first stator vane are located closer to the gas inlet port than the other rotor and stator vanes.

3. A turbo molecular pump comprising: a rotor shaft; a bearing for rotatably supporting the rotor shaft; a motor for rotating the rotor shaft supported by the bearing; rotor vanes arranged in multiple pumping stages connected to the rotor shaft for rotation therewith; and stator vanes arranged in multiple pumping stages and interleaved with the rotor vanes; wherein an axial interval between at least a first one of the rotor vanes and a corresponding adjacent first one of the stator vanes is set to a value in accordance with a mean free path of molecules contained in a gas flowing between the rotor vanes and the stator vanes such that a discharge throughput of the turbo molecular pump during a normal operation thereof is not less than 1000 SCCM.

4. A turbo molecular pump according to claim 3; further comprising a pump body having a gas inlet port and a gas outlet port; and wherein the first rotor vane among said rotor vanes of multiple stages, and said and the first stator vane are located closer to the gas inlet port than the other rotor and stator vanes.

5. A turbo molecular pump comprising: a pump body having a gas inlet port and a gas outlet port; a rotor shaft mounted in the pump body for undergoing rotation and having a plurality of rotor vanes; a stator mounted in the pump body and having a plurality of stator vanes interleaved with the rotor vanes in spaced-apart relation; and a plurality of vacuum pumping stages disposed within the pump body between the gas inlet port and the gas outlet port, each of the vacuum pumping stages comprising at least one of the rotor vanes and at least one of the stator vanes; wherein an axial distance between the rotor vane and the stator vane of at least one of the vacuum pumping stages is set to a value in accordance with a mean free path of molecules contained in a gas flowing between the rotor vanes and the stator vanes such that a pressure at the gas inlet port is not less than 10 mTorr during a normal operation of the turbo molecular pump.

6. A turbo molecular pump according to claim 5; wherein the rotor vane and the stator vane of the at least one vacuum pumping stage are located closer to the gas inlet port than the other rotor and stator vanes of the other vacuum pumping stages.

7. A turbo molecular pump comprising: a pump body having a gas inlet port and a gas outlet port; a rotor shaft mounted in the pump body for undergoing rotation and having a plurality of rotor vanes; a stator mounted in the pump body and having a plurality of stator vanes interleaved with the rotor vanes in spaced-apart relation; and a plurality of vacuum pumping stages disposed within the pump body between the gas inlet port and the gas outlet port, each of the vacuum pumping stages comprising at least one of the rotor vanes and at least one of the stator vanes; wherein an axial distance between the rotor vane and the stator vane of at least one of the vacuum pumping stages is set to a value in accordance with a mean free path of molecules contained in a gas flowing between the rotor vanes and the stator vanes such that a discharge throughput of the turbo molecular pump during a normal operation thereof is not less than 1000 SCCM.

8. A turbo molecular pump according to claim 7; wherein the rotor vane and the stator vane of the at least one vacuum pumping stage are located closer to the gas inlet port than the other rotor and stator vanes of the other vacuum pumping stages.

* * * * *